United States Patent [19]

Focke et al.

[11] Patent Number: 5,018,625

[45] Date of Patent: May 28, 1991

[54] FOIL PACK FOR PAPER TISSUES

[75] Inventors: Heinz Focke; Kurt Liedtke, both of Verden, Fed. Rep. of Germany

[73] Assignee: Focke & Co., Fed. Rep. of Germany

[21] Appl. No.: 501,918

[22] Filed: Mar. 28, 1990

[30] Foreign Application Priority Data

Apr. 11, 1989 [DE] Fed. Rep. of Germany ..... 3911779

[51] Int. Cl.[5] ..... B43M 7/00

[52] U.S. Cl. ..... 206/621; 206/622; 206/628

[58] Field of Search ..... 206/621, 622, 628, 604, 206/605, 622, 449, 499, 606, 800

[56] References Cited

U.S. PATENT DOCUMENTS

| | | | |
|---|---|---|---|
| 3,201,258 | 8/1965 | Mastella | 206/800 X |
| 3,266,055 | 8/1966 | Graybill | 206/622 X |
| 3,301,391 | 1/1967 | Guyer | 206/628 X |
| 4,192,420 | 3/1980 | Worrell, Sr. et al. | 206/621 X |
| 4,811,848 | 3/1989 | Jud | 206/628 X |
| 4,934,535 | 6/1990 | Muckenfuhs et al. | 206/628 X |

FOREIGN PATENT DOCUMENTS

| | | |
|---|---|---|
| 030601 | 10/1980 | European Pat. Off. . |
| 030348 | 6/1981 | European Pat. Off. . |
| 298054 | 1/1989 | European Pat. Off. . |
| 3500545 | 10/1985 | Fed. Rep. of Germany . |
| 3542999 | 8/1986 | Fed. Rep. of Germany . |
| 3612710 | 6/1987 | Fed. Rep. of Germany . |
| 8708274 | 9/1987 | Fed. Rep. of Germany . |
| 8901535 | 2/1989 | Fed. Rep. of Germany . |
| 2458480 | 1/1981 | France . |
| 667061 | 9/1988 | Switzerland . |

*Primary Examiner*—William I. Price

*Attorney, Agent, or Firm*—Sughure, Mion, Zinn, Macpeak & Seas

[57] ABSTRACT

Foil pack for paper tissues.

Packs for stacks of folded paper tissues (10) are made of very thin plastic foil or film. For easier usage, these packs have lately been provided with tear-open aids, especially in the region of a front wall (11) of the cuboidal pack. In order to open and reclose the pack, a tear-open flap (22) is defined by perforation lines (23, 24, 25) in the region of the front wall (11), which can be opened and reclosed with the aid of a covering adhesive flap (37).

In order to increase the function value of the foil pack, the tear-open flap (22) limited by side perforations (23, 24) is narrower than the front wall (11), especially such that a recess (32) of sufficient size for extracting a paper tissue (10) is formed. Adjoined to the perforations of the tear-open flap (22) is a transverse perforation (28, 29) in the region of a front edge (26), which is opened by way of lifting the end wall of the pack. Herewith, an extraction opening (21) extending across the whole width is formed.

With this embodiment of the tear-open aid it is of advantage to design the pack such that folding flaps of the end wall 16 are separated by means of punch cuts (43, 44) and can thus be folded in rectangular shape.

10 Claims, 7 Drawing Sheets

FOIL PACK FOR PAPER TISSUES

DESCRIPTION

Figure 1:
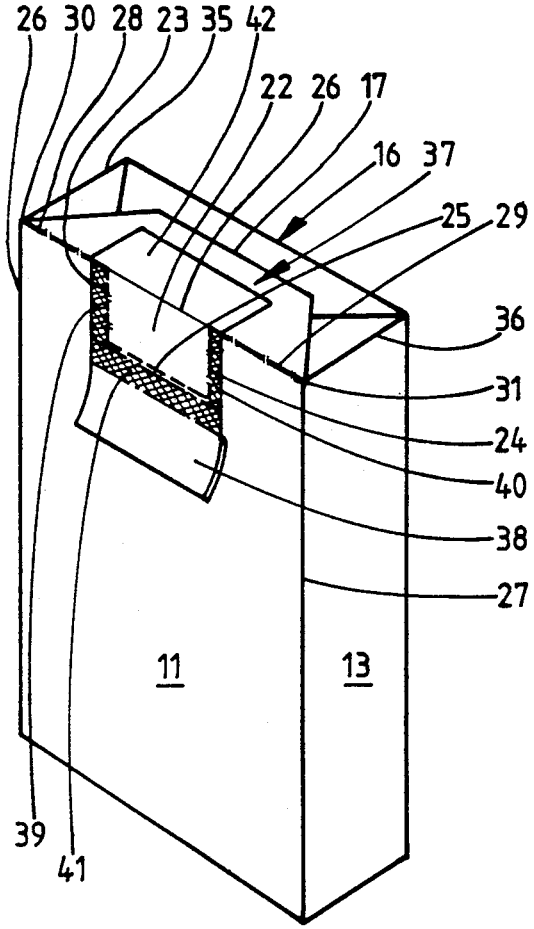

The invention relates to a cuboidal foil pack for paper pulp products, especially for stacks of paper tissues, having a tear-open flap limited by perforation lines in the region of a (large-surfaced) front wall and an adhesive flap with adhesive-free grip end, said adhesive flap covering the (lower) end of said tear-open flap, said tear-open flap being laterally limited by perforation lines (side perforations) extending in the direction of an edge (front edge) formed between front wall and a (small-surfaced) end wall.

Paper tissues are conventionally packed in thin foil or film for forming a foil pack with a tack of for instance ten paper tissues. The shape of this cuboidal foil pack is chosen such that a large-surfaced front and rear wall, smaller elongated narrow side faces, and even smaller rectangular upper and lower end faces are formed. In the region of these end faces, folding flaps of the foil blank, namely longitudinal flaps and side flaps, are usually folded envelope-like.

More and more of these kind of foil packs are provided with reclosable opening aids.

The invention is concerned with foil packs of this type and is based on the object to improve the design of such a foil pack, especially as regards easy handling, stability and easy mass industrial production.

In order to attain this object, the foil pack as defined by the invention is characterized by the following features:

a) the perforation lines (side perforations) laterally limiting the tear-open flap terminate at the edge (front edge) formed between front wall and end wall at a (significant) distance to pack corners formed between front wall and end wall, b) from the ends of the side perforations, there extend transversely oriented perforation lines (transverse perforations) along the front edge up to the pack corners.

The invention sets out from the recognition that the (reclosable) tear-open aid has to be adapted to the geometrical shape of the pack contents, so it can serve for extracting the flat and folded paper tissues. For this purpose, the tear-open flap is dimensioned such that in opened position, a recess is formed in the front wall, which is big enough for centrally grasping the paper tissue with two fingers (thumb and index finger). Furthermore, there is a slit-shaped opening on the upper edge of the foil pack in the region of the front edge, which makes it possible to easily extract one single tissue at a time without any force.

According to a particularly important feature of the invention, the tear-open flap is completely covered by the adhesive flap. This particularly facilitates the opening process when the pack is put into use and also the reclosing, as the whole surface of the labile tear-open flap is held by the adhesive flap.

The transverse perforations extending along the front edge and adjoining to the side perforations of the tear-open flap are severed by means of lifting or pulling up the end wall with the aid of the adhesive flap, so that the extraction opening extending over the whole width of the foil pack is formed in one step.

The opening aid according to the invention can by analogy also be formed broadwise along the pack. In this case, the side perforations of the tear-open flap extend towards a longitudinal front edge of the pack which is formed between front wall and a side wall of the pack. The transversely oriented perforation lines (transverse perforations) extend in the aforesaid longitudinal front edge up to the respective corners. In this embodiment, the tear-open flap is formed to be very small (narrow) relative to the length of the longitudinal front edge, specifically such that one tissue at a time can be grasped with two fingers in the region of the opened tear-open flap.

Figure 2:
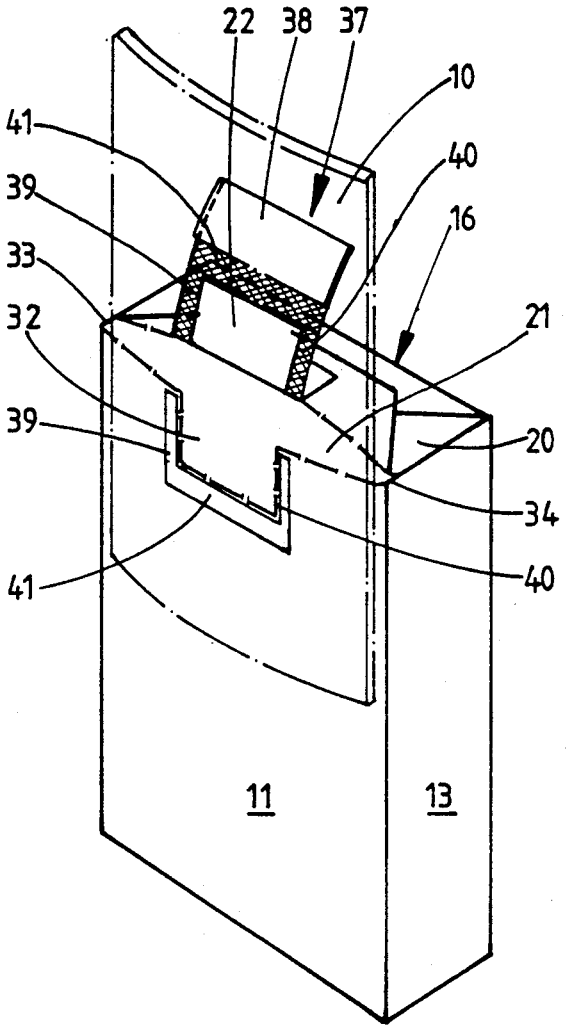
Figure 3:
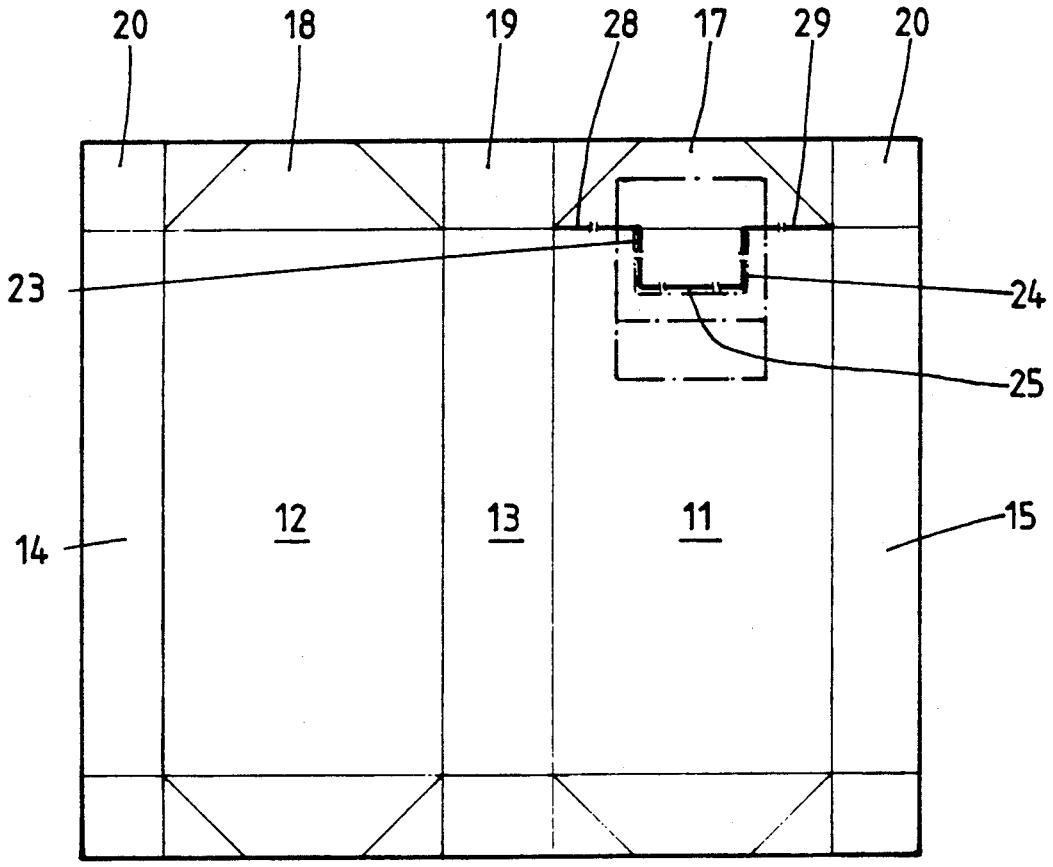
Figure 4:
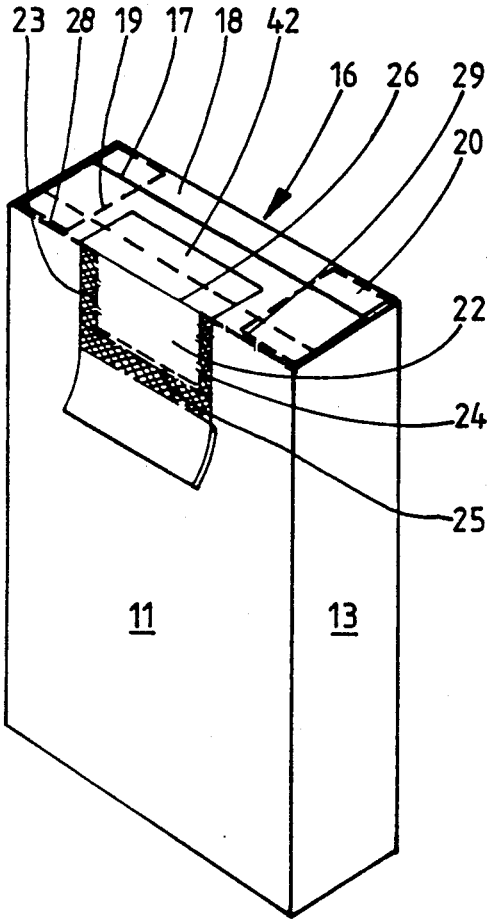
Figure 5:
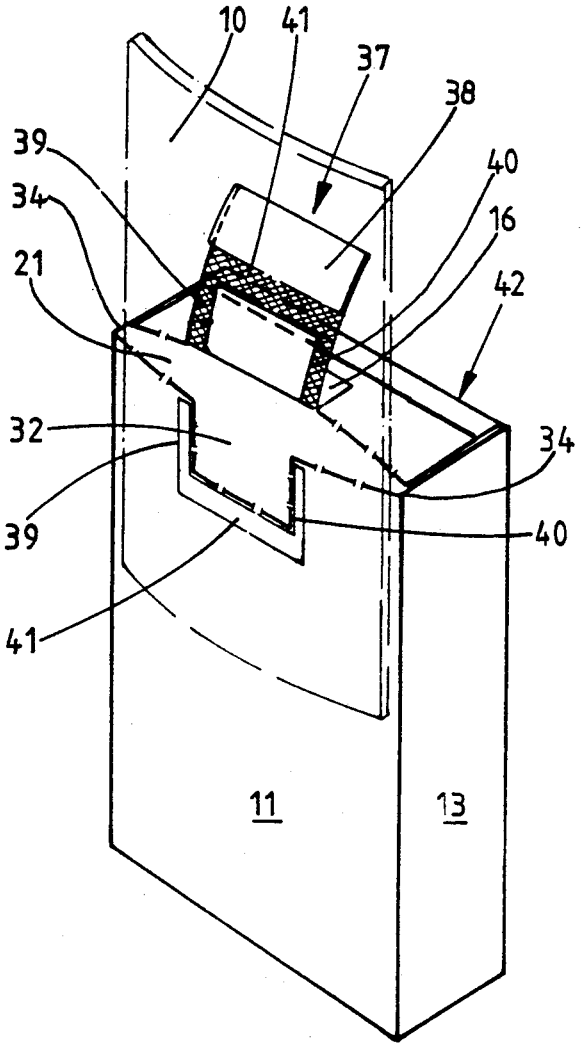
Figure 6:
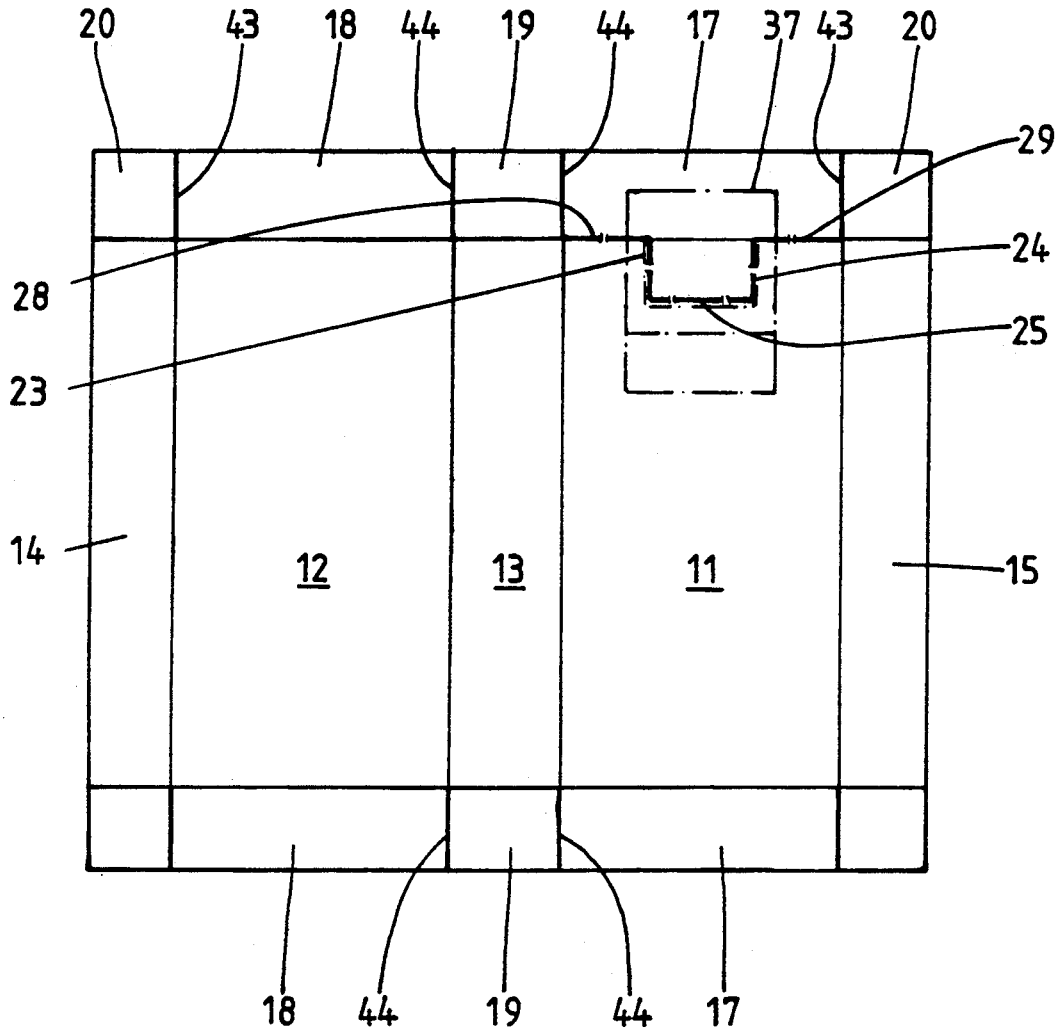
Figure 7:
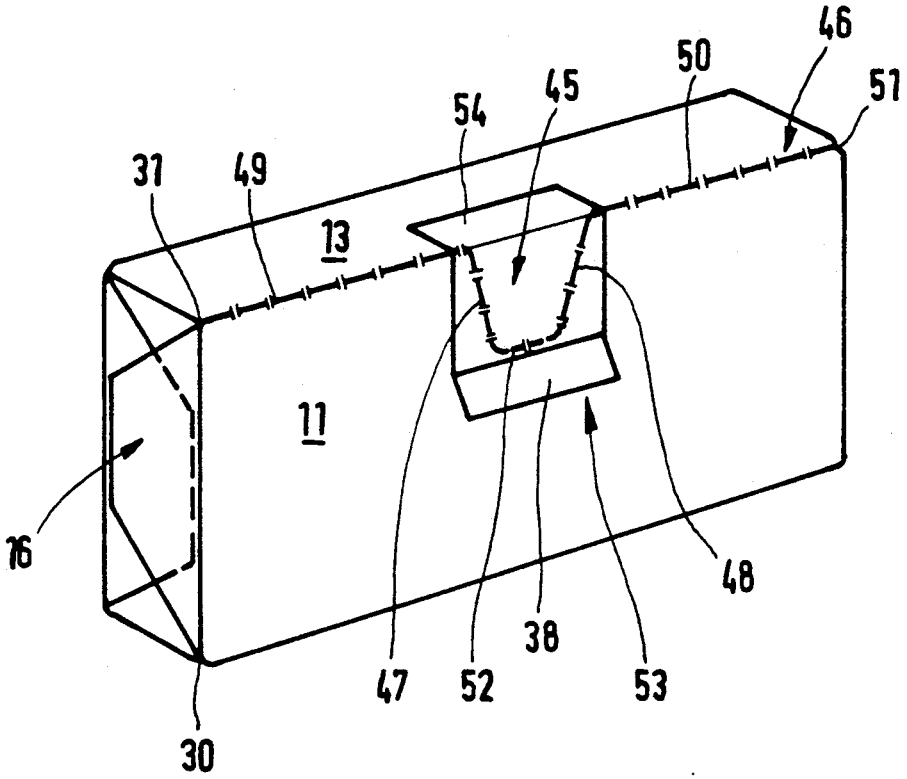
Figure 8:
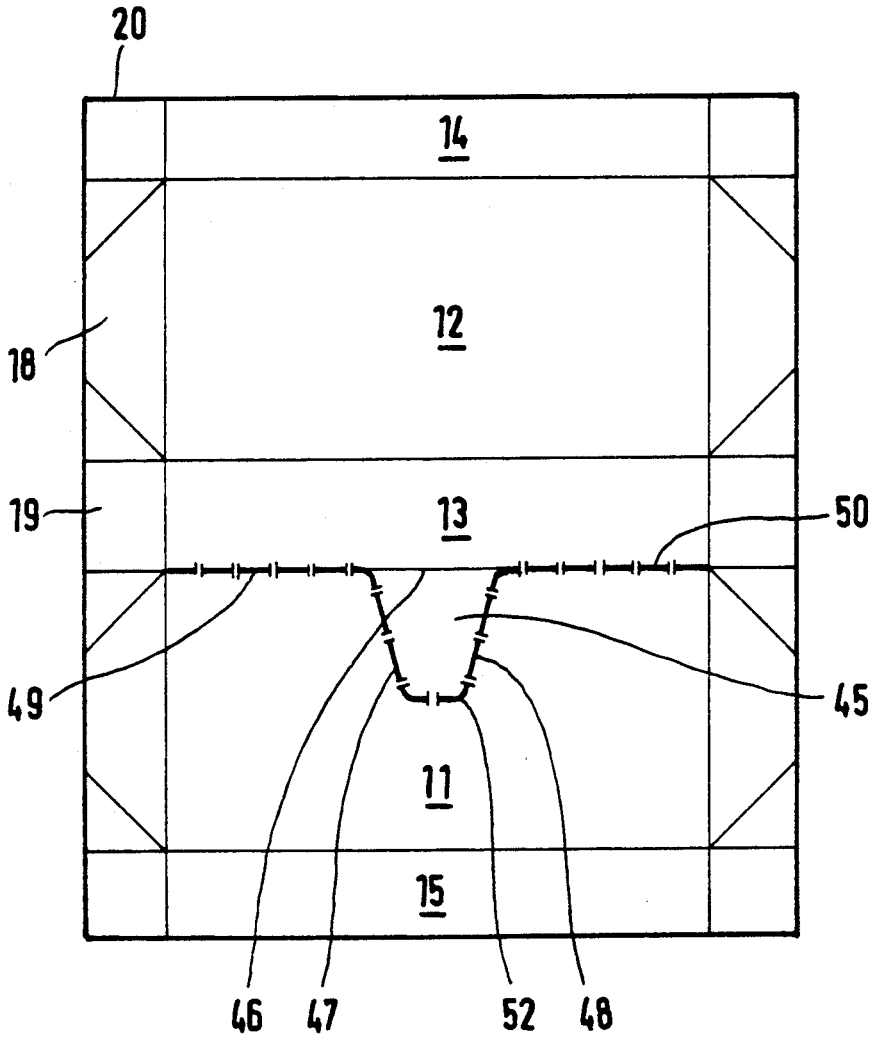
Figure 9:
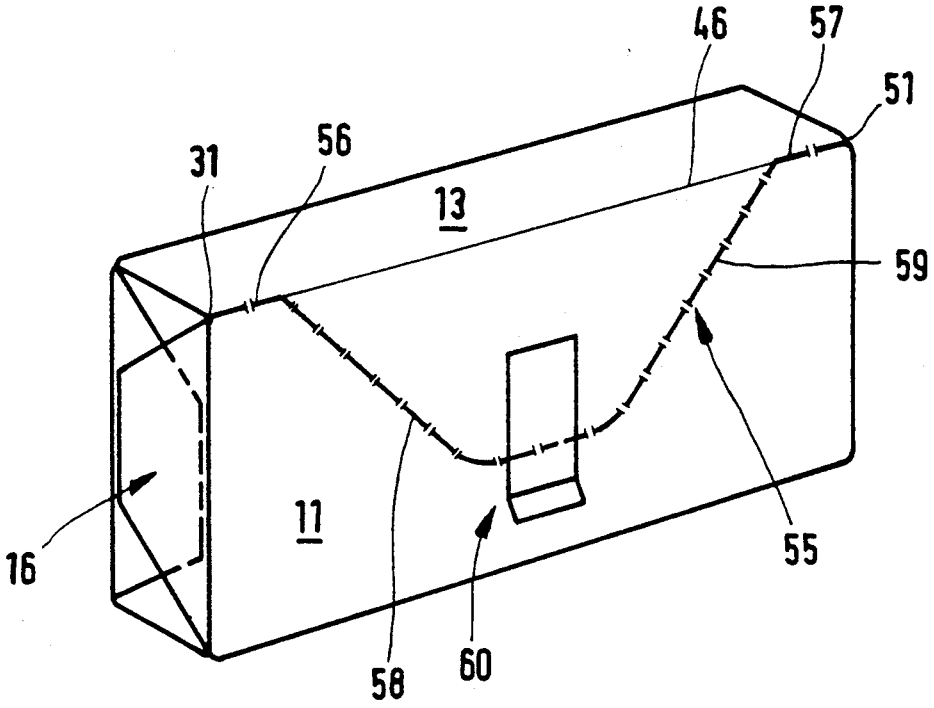

Further details of the invention relate to the design of the pack or the tear-open aid. Exemplary embodiments are explained in more detail below with reference to the drawings which show:

FIG. 1 a perspective view of a foil pack for paper tissues in closed position, FIG. 2 another perspective view of the pack according to FIG. 1 in opened position for extracting a tissue, FIG. 3 an opened out blank for the pack according to FIGS. 1 and 2, FIG. 4 a perspective view of another embodiment of the foil pack in closed position, FIG. 5 another perspective view of the pack according to FIG. 4 in opened position, FIG. 6 an opened out blank for a pack according to FIGS. 4 and 5, FIG. 7 a perspective view of a further embodiment of a foil pack in closed position, FIG. 8 an opened out blank for a pack according to FIG. 7, FIG. 9 a perspective view of a further modified embodiment of a foil pack.

The embodiments of foil packs shown in the drawings serve for holding a stack of folded paper tissues 10. The pack consists of thin, preferably thermally sealable plastic foil of a thickness of 30u or more.

The pack is of cuboidal shape. The embodiment of FIGS. 1 and 2 consists of a (rectangular) blank according to FIG. 3 which is showing folding lines for limiting a front wall 11, a rear wall 12 and a narrow side wall 13 limited by said front and said rear wall. An oppositely situated side wall is formed by side wall flaps 14, 15, which overlap one another and which are connected to one another by sealing.

Adjoined to the aforementioned faces of the blank are folding flaps for forming an upper end wall 16 and an opposite lower bottom wall. These folding flaps consist of outer and inner longitudinal flaps 17, 18 in the region of front wall 11 and rear wall 12. Furthermore, side flaps 19, 20 adjoin to the side wall 13 and the side wall flaps 14, 15 connected to one another. The end wall 16, and in analogy the bottom wall, is folded such that in a tube-like intermediate folding position of the blank or pack, the side flaps 19, 20 are first folded against the pack contents and then the inner longitudinal flap 18 and finally the outer longitudinal flap 17 are folded. The aforementioned folding flaps are connected to one another by sealing.

The rectangular front wall 11 is provided with a tear-open aid which is arranged in the upper region, adjacent to end wall 16.

In order to form an extraction opening 21 for the paper tissues 10, a tear-open flap 22 is formed in the front wall 11. Said tear-open flap extends in the central region of the front wall 11 and is limited by weakening lines in the foil, specifically by perforation lines. The tear-open flap 22 is laterally limited by side perforations 23, 24. These perforations extend from a lower transversely oriented connecting perforation 25 in the direction of a pack edge formed between front wall 11 and end wall 16, specifically to a front edge 26. The side perforations 23, 24 extend up to this front edge 26. The connecting perforation 25 limiting the tear-open flap 22 below can also be formed as completely or partially penetrating punch cut.

The side perforations 23, 24 extend in significant distance to the edges of the front wall 11, i.e. upright pack edges 26, 27. The tear-open flap 22 of the preferred embodiment of the foil pack has a width big enough to grasp the tissue with two fingers (index finger, thumb) after said tear-open flap 22 has been pulled off and to upwardly pull out the tissue of the foil pack. The width of the tear-open flap 22 can thus be 2 cm to 3 cm.

Adjoining to the upper free ends of side perforations 23, 24 are transversely oriented perforation lines, namely transverse perforations 28, 29. These perforations extend along the front edge 26 up to the end of said edge, that is to say to pack corners 30, 31 between end wall 16 and front wall 11.

When the tear-open flap 22 is torn out of the front wall 11 and the transverse perforations 28, 29 are subsequently severed, an extraction opening 21 extending across the whole width of the foil pack or front wall 11 is exposed. By means of a preferably central recess 32 in front wall 11, the foremost paper tissue 10 can now be grasped and upwardly pulled out without any force.

In order to enlarge the extraction opening 21, corner perforations 33, 34 can adjoin to the transverse perforations 28, 29, said corner perforations extending along side edges 35, 36 between end wall 16 and side wall 13 or side wall flaps 14, 15. The corner perforations 33, 34 are only of a small length.

When the pack is in closed position (FIG. 1), the tear-open flap 22 is covered by an adhesive strip or flap 37 which is made of a preferably thicker foil material. The whole surface of the face of this adhesive flap 37 which is facing the pack is coated with an adhesive. The adhesive flap 37 completely covers the tear-open flap 22, said tear-open flap being connected to said adhesive flap with its complete surface. In the region of front wall 11, the adhesive flap 37 forms a lower adhesive-free grip end 38, with which the adhesive flap 37 can be grasped and handled.

The adhesive flap 37 is dimensioned such that it projects laterally and below from the tear-open flap 22. The adhesive flap 37 is connected with side strips 39, 40 and a transverse strip 41 along a U-shaped adhesive contour (FIG. 2) to the front wall 26 beyond the region of the tear-open flap 22. Furthermore, the adhesive flap 37 extends into the end wall 16 with a sufficiently dimensioned leg 42. The whole surface of leg 42 is adhesively connected to the outer longitudinal flap 17.

When the grip end 38 is grasped and the adhesive flap 37 pulled, said adhesive flap is pulled off the front wall 11 in the region of transverse strip 41 and side strips 39, 40. Since the complete surface of the tear-open flap 22 is connected to the adhesive flap 37, the tear-open flap is torn out of the perforation connection with front wall 11. The adhesive flap 37 can be moved together with the tear-open flap 22 in an upright or backwardly tilted position (FIG. 2), thus uncovering the recess 32. By further pulling the adhesive strip 37, the end wall 16 is lifted and the transverse perforations 28, 29 are severed so that the extraction opening 21 is exposed.

The pack can be reclosed by means of pivoting the adhesive flap 37 back into initial position according to FIG. 1. The tear-open flap 22 is herewith moved back into position within recess 32 according to FIG. 1. Adhesive flap 39 is reconnected to the front wall 11 by means of side strips 39, 40 and transverse strip 41.

The difference of the embodiment according to FIGS. 4 to 6 to the aforedescribed embodiment is the formation of the end wall 16. The folding flaps of the end wall 16 (and the bottom wall) are separated from one another by means of punch cuts 43 and 44. Consequently, the longitudinal flaps 17, 18 are not of trapezoidal shape when folded as in the embodiment according to FIGS. 1 to 3, but rectangular. As can be seen in FIGS. 4 and 5, the longitudinal flaps 17, 18 of this embodiment extend across the whole length of the end wall 16. With this embodiment, a particularly advantageous bonding or sealing of the folding flaps in the region of end wall 16 is made possible, thus facilitating the opening process. Moreover, the blank according to FIG. 6 also has advantages as regards production technique.

FIGS. 7 and 8 show an advantageous embodiment of the opening aid in "broadside" arrangement. Here, a tear-open flap 45 is also arranged in the region of the front wall 11, but extends in the direction of a longitudinal front edge 46 which extends between the (enclosed) side wall 13 and front wall 11. Side perforations 47, 48 of the tear-open flap 45 merge into transverse perforations 49, 50 which extend along the longitudinal front edge 46 up to pack corners 31 and 51 at the ends of the longitudinal front edge 46. The tear-open flap 45 is formed relatively small—compared to the longitudinal dimension of the front wall 11. The side perforations 47, 48 are slightly inclining relative to one another, thus diverging towards the longitudinal front edge 46, so that the tear-open flap 45 is nearly V-shaped. The lower ends of side perforations 47, 48 being situated at a distance from the longitudinal front edge 46 are linked to one another by means of a connecting perforation 52. The transition points between the different perforations are rounded off, thus facilitating the opening process. The width of the tear-open flap 45 is dimensioned such that the edge of a paper tissue 10 can be grasped in a center region with two fingers.

The tear-open flap 45 is covered by an appropriately dimensioned rectangular adhesive flap 53. The width and length of this adhesive flap 53 are dimensioned such that the tear-open flap 45 is completely within the region covered by the adhesive flap 53. Lateral projections of the adhesive flap 53 extending beyond the tear-open flap 45 are connected to the front wall 11. A leg 54 extends into a side wall 13 adjoining to the front wall. Moreover, the design of the adhesive flap 53 corresponds to that of the aforedescribed exemplary embodiments.

The blank for this pack corresponds to that of the afore embodiments. As can be seen, the tear-open aid is located in the region of the enclosed side wall 13 extending approximately in the middle of the blank.

FIG. 9 shows a modification of the embodiment according to FIGS. 7 and 8. A tear-open flap 55 of relatively large dimensions is located in the region of the front wall 11 and extends across the longer section of the front wall 11 or longitudinal front edge 46. Correspondingly, transverse perforations 56, 57 in the region of the longitudinal edge 46 are relatively short in length. Side perforations 58, 59 for limiting the tear-open flap 55 are diverging more strongly relative to one another.

With this embodiment of the pack, a bigger opening is exposed in the region of the front wall 11. The tear-open flap 55 is only partially covered by an adhesive flap 60 solely extending in the region of the front wall 11.

What is claimed is:

1. A cuboidal foil pack for stacks of folded paper tissues, having a tear-open flap limited by perforation lines in the region of a (large-surfaced) front wall and an adhesive flap with adhesive-free grip end, said adhesive flap covering the (lower) end of said tear-open flap, said tear-open flap being laterally limited by perforation lines (side perforations) extending in the direction of an edge (front edge) formed between said front wall and a (small-surfaced) end wall, comprising the following features:

a) the perforation lines (side perforations 23, 24) laterally limiting said tear-open flap (22) terminate at the edge (front edge 26) formed between said front wall (11) and said end wall (16) at a (significant) distance to pack corners (30, 31) formed between said front wall (11) and said end wall (12), b) from the ends of said side perforations (23, 24), there extend transversely oriented perforation lines (transverse perforations 28, 29) along said front edge (26) up to said pack corners (30, 31).

2. The foil pack according to claim 1, wherein the complete surface of said tear-open flap (22) is connected to and covered by said adhesive flap (37).

3. The foil pack according to claim 2, wherein the (rectangular) adhesive flap (37) is bigger in width than said tear-open flap (22) and wherein across the whole length of said tear-open flap (22), lateral adhesive edges of said adhesive flap (37) are bonded to regions of said front wall (11) adjoining said tear-open flap (22) (side strips 39, 40).

4. The foil pack according to claim 2 or 3, wherein said adhesive flap is connected to said front wall (11) with a transverse strip (41) below said tear-open flap (22), such that together with said side strips (39, 40) there is a U-shaped contour of the adhesive bondage of said adhesive flap (37) with said front wall (11).

5. The foil pack according to claim 1 or 2, wherein said adhesive flap extends with an extension (leg 42) into said end wall (16) and is adhesively bonded to said end wall (16) or an outer longitudinal flap (17) of said end wall (16).

6. The foil pack according to claim 1 or 2, wherein short corner perforations (33, 34) along side edges (35, 36) adjoin to the free ends of said transverse perforations (28, 29) in the region of said pack corners (30, 31).

7. The foil pack according to claim 1 or 2, wherein said front wall (16) is formed by (inner and outer) longitudinal flaps (17, 18) and side flaps (19, 20) separated from one another by means of punch cuts (43, 44), the longitudinal flap (17) adjoining to said front wall (11) lying on the outside.

8. A cuboidal foil pack for stacks of folded paper tissues, having a tear-open flap limited by perforation lines in the region of a (large-surfaced) front wall and an adhesive flap with an adhesive-free grip end, said adhesive flap covering the (lower) end of said tear-open flap, said tear-open flap being laterally limited by perforation lines (side perforations) extending in the direction of an edge (longitudinal front edge) formed between said front wall and a (narrow) side wall, comprising the following features:

a) the perforation lines (side perforations 47, 48) laterally limiting said tear-open flap (45) terminate at the edge (longitudinal front edge 46) formed between said front wall (11) and said side wall (13) at a (significant) distance to pack corners (31, 51) formed between said front wall (11) and said side wall (13), b) from the ends of said side perforations (47, 48), there extend transversely oriented perforation lines (transverse perforations 49, 50) along said longitudinal front edge (46) up to said pack corners (31, 51).

9. The foil pack according to claim 8, wherein a tear-open flap (45) preferably disposed centrally in said front wall (11) is narrow relative to the dimension of said longitudinal front edge (46), the complete surface of said tear-open flap (45) being connected to and covered by said adhesive flap (53).

10. The foil pack according to claim 9, wherein the side perforations (47, 48) limiting said tear-open flap (45) are extending slightly diverging to said transverse perforations (49, 50).

* * * * *